5/27/86 XR 4,591,995

United States Patent [19]

Schürch

[11] Patent Number: 4,591,995

[45] Date of Patent: May 27, 1986

[54] PROCESS AND DEVICE FOR MONITORING SINGLE STRANDS IN STRANDING PROCESSES

[75] Inventor: Robert Schürch, Uster, Switzerland

[73] Assignee: Zellweger Uster Ltd., Uster, Switzerland

[21] Appl. No.: 473,212

[22] Filed: Mar. 8, 1983

[30] Foreign Application Priority Data

May 18, 1982 [CH] Switzerland ..... 3072/82

[51] Int. Cl.[4] ..... G01N 29/04; G06F 15/46; G05B 12/02

[52] U.S. Cl. ..... 364/507; 364/469; 364/552; 73/637; 382/58

[58] Field of Search ..... 364/560, 468–469, 364/507, 550, 551, 552, 470; 73/615, 616, 637, 638, 641; 57/293; 382/58

[56] References Cited

U.S. PATENT DOCUMENTS

| | | | |
|---|---|---|---|
| 3,885,232 | 5/1975 | Goto | 364/468 |
| 3,981,184 | 9/1976 | Matay | 364/468 |
| 3,996,791 | 12/1976 | Niklas et al. | 364/507 |
| 4,049,954 | 9/1977 | Da Costa Vieira et al. | 364/560 |
| 4,051,722 | 10/1977 | Feller | 364/470 |
| 4,246,748 | 1/1981 | Artzt et al. | 364/470 |
| 4,378,495 | 3/1983 | Miller | 344/507 |
| 4,430,720 | 2/1984 | Aemmer | 364/470 |
| 4,433,385 | 2/1984 | De Gasperi et al. | 364/507 |

*Primary Examiner*—Errol A. Krass
*Assistant Examiner*—Thomas G. Black
*Attorney, Agent, or Firm*—Antonelli, Terry & Wands

[57] ABSTRACT

For monitoring stranding machines for breakage or run-out of single strands, a device is employed which checks the rope or cable after stranding for uniformity of the rope or cable surface. For this purpose, an electrical image of the rope or cable surface is read into a memory and the measured values compared with this stored pattern during the further stranding process. In the event of deviations resulting from this comparison, disconnecting or other actuating elements are actuated in order to avoid the production of further faulty lengths of rope or cable. For reflection measurements, electromagnetic, optical or acoustic waves can be employed. Instead of scanning of the rope or cable surface based on reflection, corpuscular radiation which partially penetrates the rope or cable can be employed.

14 Claims, 6 Drawing Figures

PROCESS AND DEVICE FOR MONITORING SINGLE STRANDS IN STRANDING PROCESSES

FIELD OF THE INVENTION

The invention relates to a process and a device for the monitoring of single strands in stranding processes in which the strands involved in the stranding of a rope or cable are investigated for correct sequence, correct surface quality, breakages or run-outs.

BACKGROUND OF THE INVENTION

Single strands can be made of metallic as well as nonmetallic materials, or hybrids thereof, such as insulated strands. Also, the so-called fillers (nonmetallic strands whose inherent function is for filling the rope or cable cross-section) are considered to be single strands as well.

Ropes or cables are manufactured on stranding machines on which are fitted bobbins carrying the single strands and in which these bobbins themselves are mounted on a rack, which is sometimes referred to as a carriage. The rope or cable is fabricated by rotating the carriage and simultaneously drawing out the strand. However, as is known, it is also possible to carry out stranding when the carriage is fixed by rotating the entire rope take-up device and drawing out the strand.

Independent of the type of stranding principle employed, an electromechanical pick-up normally has been provided for each strand used to form the rope or cable in order to monitor the individual strands. These pick-ups are designed to produce an electrical pulse on failure of the strand tension resulting from breakage or run-out of the strand, and this electrical pulse is used to stop the stranding process. Despite the advantages afforded by this electromechanical monitoring arrangement, such as simple construction, good operational reliability and independence of strand material, this type of monitoring also has various disadvantages. In this regard, for transmitting the pick-up signals from the rotating carriage to the monitoring and control equipment, wiper rings are required with their sufficiently well-known shortcomings. Also, in the event of a strand breaking, the relevant strand section in the vicinity of the pick-up can remain tensioned, so that the pick-up is not influenced by this strand section and the break in the strand goes undetected.

Other monitoring systems which have become known use a proximity detector operating on a capacitive, inductive or optical principle, located at a short distance in front of the stranding point. With each rotation of the carriage carrying the bobbins supplying the single strands, the correct number of single strands must be constantly sensed by the proximity detector, and, in the event of one or more missing strands, a machine stop signal is generated by the associated electronic system. This type of monitoring system requires only a small number of mechanical and electronic parts, and also has the disadvantage of dispensing with any need for the unreliable wiper rings required in other systems. On the other hand, strands breaking in the region of or after the stranding point and which stick at any part, go undetected. Furthermore, adjustment of the proximity detector or the data to be ascertained by it is necessary if the strand material is changed.

BRIEF DESCRIPTION OF THE INVENTION

The present invention avoids the disadvantages of the prior art in providing a process and a device for monitoring single strands in the course of rope or cable manufacture for correct sequence, correct surface quality, breakages or run-outs during the stranding process by use of a transmitter for transmitting wave energy of a specified type onto the rope or cable and sensors for receiving the reflected or absorbed part of the wave energy from the rope or cable.

The process in accordance with the invention makes use of the possibilities offered by the storage of electrical signals in suitable memories. In this respect, the reference pattern corresponding to the reference characteristic of the signal to be assessed can be obtained from a fault-free sample of the rope or cable and read into the memory. Every change of rope or cable type can thus be taken into account by a simple assessment of the suitably-stored reference characteristic relating thereto. It is, however, also possible to represent the reference pattern not by scanning a fault-free rope section but by using a computational algorithm, which simulates the characteristic of the reference signal, and programming the artificially-generated signal characteristic in the memory.

The wave energy for the transmitters and sensors can be in the form of electromagnetic waves, acoustic waves as well as those which utilize nuclear physical phenomena. Reflecting processes or mass-penetrating vibrations can equally well be used depending on the type of rope or cable material and type of rope or cable fabrication.

The process and corresponding devices which are the subject of the invention are particularly advantageous because they are less dependent on the type of stranding machine than customary monitoring devices, and even more importantly, because the position of the measuring point at which the measuring device must be employed in the stranding machine is not critical. In addition, it is not necessary for the measuring point (in particular, the transmitter and the sensor) to describe a circular or helical path around the rope or cable in order to scan a continuous line longitudinally over its surface. Because of the property and characteristics of the rope or cable when it issues from the stranding point where the individual strands are wound in a helix about a core, the measuring point can be located in a stationary position, since all the strands forming the rope or cable surface move past the measuring point.

If, however, the device which is the subject of the invention is applied at a rope or cable which has already passed the stranding process and which therefore no longer rotates about its axis (for example, in subsequent testing of an already-stranded rope or cable), the measuring poit must be moved along the rope or cable. But in this case also, as a result of the helical arrangement of the single strands forming the cable or rope, only a linear movement of the measuring point is needed, and thus, orbiting of the rope or cable with all the therewith-associated disadvantages can be avoided.

These and other features and advantages of the present invention will become more apparent from the following detailed description of various preferred embodiments as illustrated in the accompanying drawings.

DETAILED DESCRIPTION OF THE PREFERRED EMBODIMENTS

A rope or cable is constructed of a number of strands which are wrapped around each other and thereby fill out a particular cross section. Thus, the present invention relies on the fact that the surface of the rope or cable is thereby structured in most cases with a definite pattern which is predictable. If special requirements in application require a smooth surface, then this process can be used to check the stranded intermediate product before the fitting of the smooth surface sheathing thereto.

Figure 1:
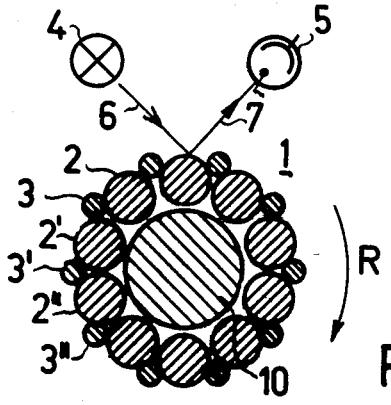
FIG. 1 is a schematic view of a rope or cable in cross section associated with the monitoring device of the present invention.

The rope or cable cross section 1, which is shown as an example in FIG. 1, consists of a large diameter center strand 10 around which is wrapped a number of smaller diameter peripheral strands 2, 2', 2'' . . . In addition, the intermediate spaces may be filled with so-called fillers 3, 3', 3'' . . . to avoid excessively-large cavities in the remaining cross sections. Each strand can itself thereby be constructed as a rope or cable. It is essential for the process, which is the subject of this invention, and its implementation that the surface of the rope or cable along a peripheral line, which can also be regarded as a helix, normally provides a constantly-repeating structure or pattern, so that every flaw of a strand will disturb this continuous structure or pattern.

Figure 2:
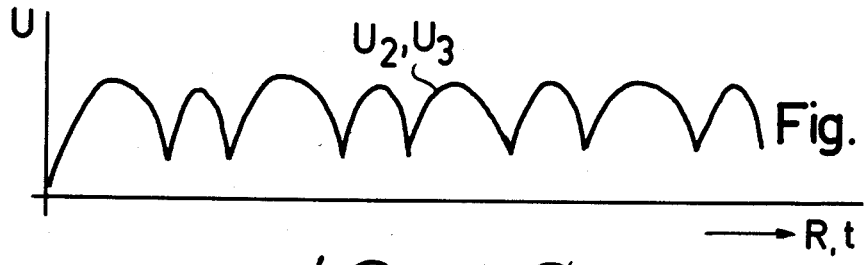
FIG. 2 is a waveform diagram of a possible signal derived from scanning a path about the periphery of a rope or cable in accordance with FIG. 1.
Figure 3:
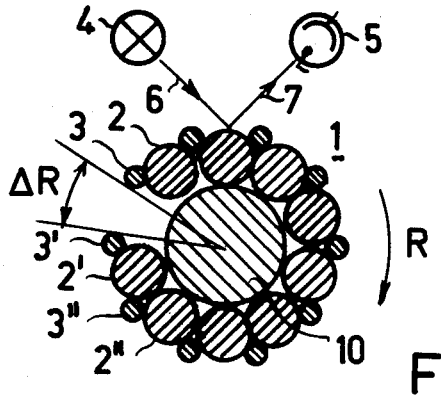
FIG. 3 is a schematic view of a faulty rope or cable in cross section with the associated monitoring device of the present invention.
Figure 4:
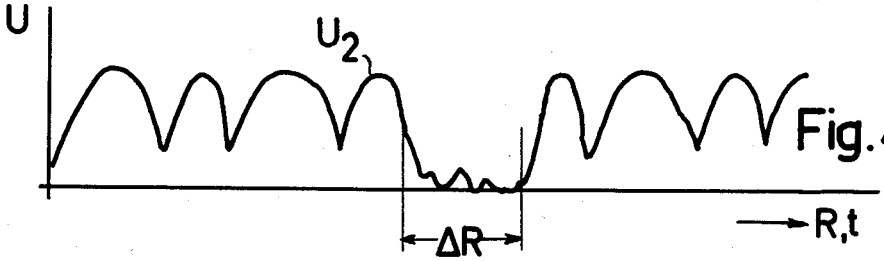
FIG. 4 is a waveform diagram of a possible signal derived by scanning a path about the periphery of a rope or cable in accordance with FIG. 3.

The surface of the rope or cable is scanned by means of suitable measuring devices, shown schematically in FIG. 1 in the form of a transmitter 4 and a sensor 5. This will produce a possible measuring signal as seen in FIG. 2, in which the amplitude A of the reflected part 7 of the radiation 6 received by the sensor 5 is represented as a function of the distance R along the periphery or of the time t, respectively, provided that the periphery of the rope is scanned proportional to time. FIG. 3 illustrates a flawed rope or cable in which one of the peripheral strands $2^i$ is missing. The corresponding waveform diagram (FIG. 4) shows a break at point $\Delta R$ along the peripheral axis R.

The invention consists of a process in which a signal pattern in accordance with FIG. 2 is stored in analog or digital form, and during the subsequent rope or cable production, the particular surface signal obtained is compared for conformity with the stored signal pattern. In the event of differences which exceed a specified tolerance limit, a switching device is triggered, which may for example shut off the stranding machine. By selecting suitable tolerance limits, it is not merely possible to detect faulty ones of the strands 2 and 3, it is also possible to discover irregularities in the external arrangement of the strands and thus faults in the construction of the rope or cable 1.

Figure 5:
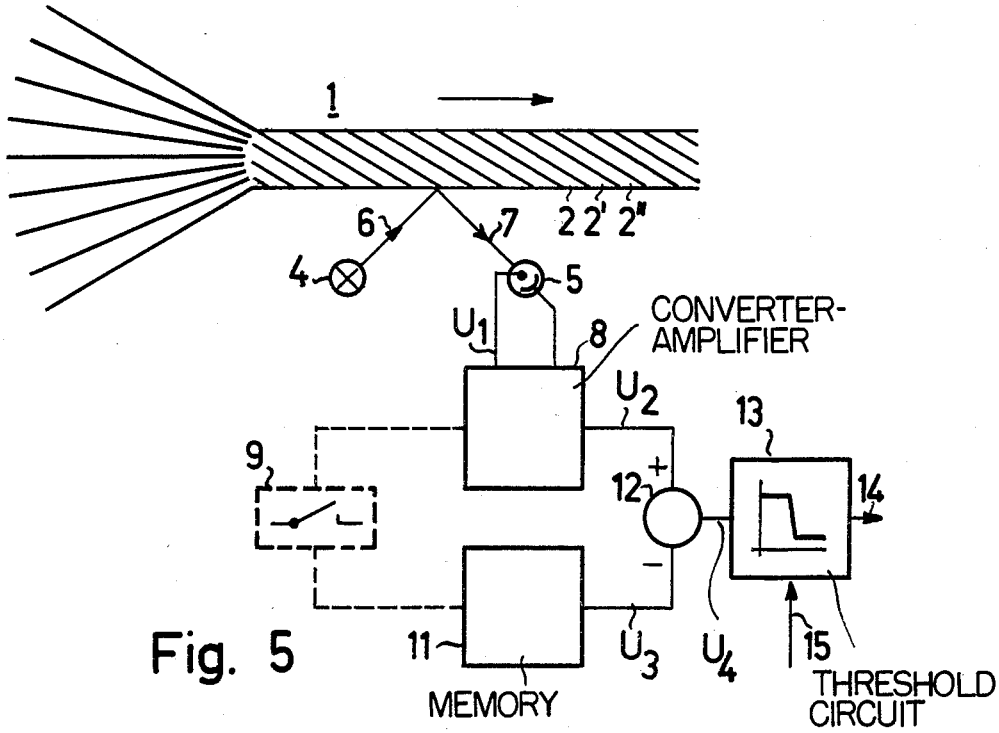
FIG. 5 is a schematic block diagram of the circuit forming one embodiment of the monitoring device of the present invention.

FIG. 5 is a block diagram of a measuring and comparing device forming a monitoring device in accordance with this invention, which may be provided as an analog or a digital device. A transmitter, for example, a light source 4, directs a light beam 6 onto the surface of the rope or cable 1 at a point in the course of the stranding process where the rope or cable already has its external form. The light 7 reflected at the single strands 2, 2', 2'' . . . is received by the sensor 5 and is applied as an equivalent electrical signal $U_1$ to a converter-amplifier 8, which may include an analog-to-digital converter if a digital device is desired.

During a particular interval of time, for example, during time t needed for one revolution R of the rope or cable 1 in the region of the reflection point, the signal $U_2$ from the converter-amplifier 8 forms a pattern corresponding to the surface of the rope or cable 1 approximately as shown in FIG. 2. This pattern is now compared in a comparator 12 with a reference pattern which is also present as an electrical signal $U_3$ in a memory 11. The comparator is shown in FIG. 5 as an analog element, but it may be of digital type for use with a digital memory 11. If the difference signal $U_4$ is within a tolerance range specified by means of a discriminator stage 13, the rope or cable section being monitored can be assessed as fault-free. The tolerance range 13 can be adjusted to particular requirements of the cable or rope by means of an externally-applied control quantity or variable 15. If the tolerance limits 15 are exceeded by the difference signal U4, an alarm signal 14 is triggered which, for example, can cause the stranding machine to be shut off.

The electrical signal $U_3$ forming the reference pattern can, for example, be obtained by scanning a fault-free section of a rope or cable and transmitting the signal $U_1$ thereby obtained by way of a coupling stage 9 to the memory 11 where it is retained as a reference image for further monitoring. When changing the stranding program to a different rope or cable pattern, the previously-stored reference pattern is deleted and the new reference pattern stored.

On the other hand, the system may also be computer controlled and include a memory which stores a plurality of different reference patterns relating to different rope or cable structures. In this way, different rope or cable stranding operations may be monitored simultaneously at different locations. In addition, by suitable computer analysis of the differences between the detected pattern signal and the stored reference pattern, specific problems in the stranding operation can be detected and isolated, so that adjustments and repairs can be easily and quickly made in the equipment.

The device which is the subject of this invention is associated with an additional advantage in that only the elements containing the transmission source 4 and the sensor 5 need to be employed in the region of the rope or cable strand. In this regard, the evaluation parts of the equipment, such as amplifier, memory, etc., can be located at any position.

Figure 6:
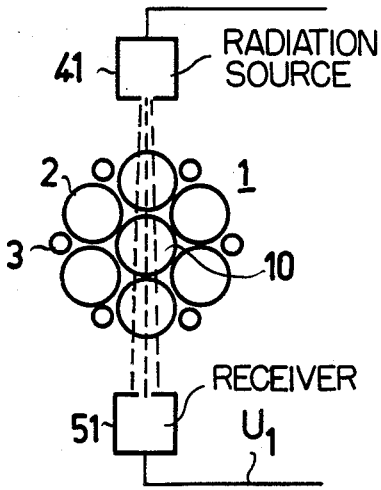
FIG. 6 is a schematic diagram of an arrangement providing an absorption measurement through the cable cross section.

FIG. 6 illustrates a measuring arrangement in which a radiation source 41 directs a corpuscular radiation beam (X-ray, gamma or similar radiation) onto the rope or cable, and on the opposite side, there is located a receiver 51 for converting the impinging radiation into a measured signal $U_1$. Evaluation of the measured signal $U_1$ is carried out similar to the arrangement in FIG. 5.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What is claimed is:

1. A process for monitoring single strands for correct sequence, correct surface quality, breakages or run-outs in the stranding process for manufacture of multi-strand rope or cable, comprising the steps of:

storing a signal pattern representative of at least one peripheral line of a representative section in the longitudinal direction of a fault-free rope or cable;

scanning a rope or cable with wave energy along a peripheral line corresponding to that of said stored signal pattern;

converting wave energy received from said rope or cable to an electrical signal;

comparing the pattern of said electrical signal with said stored signal pattern to detect differences therebetween, and generating a fault signal when the difference between said electrical signal and said stored signal pattern exceeds a predetermined tolerance limit.

2. A process according to claim 1, wherein said signal pattern is stored as a plurality of digital values.

3. A process according to claim 2, wherein said converting step includes converting said electrical signal from analog to digital form prior to comparison with said stored signal pattern.

4. A process according to claim 1, wherein said stored signal pattern is obtained by scanning a representative section of a fault-free rope or cable in the longitudinal direction along at least one peripheral line with wave energy, detecting wave energy received from said cable or rope to produce a pattern signal, converting said pattern signal to digital form and storing said digital pattern signal.

5. A process according to claim 4, wherein said stored signal pattern is obtained from a representative section of the rope or cable being fabricated.

6. A process according to claim 4, wherein said stored signal pattern is obtained from a representative section of a rope or cable previously fabricated.

7. A device for monitoring single strands for correct sequence, correct surface quality, breakages or run-outs in the stranding process for manufacture of multi-strand rope or cable comprising:

means for storing a signal pattern representative of at least one peripheral line of a representative section in the longitudinal direction of a fault-free rope or cable;

a source including means for directing wave energy at said rope or cable along a peripheral line corresponding to that of said stored signal pattern;

detector means for detecting wave energy received from said rope or cable and for producing an output signal corresponding to said detected wave energy;

comparing means connected to said storing means and said detector means for comparing said stored signal pattern with the pattern of the output signal of said detector means; and output means connected to said comparing means for generating a signal indicative of the correctness of the sequence, surface quality and integrity of single strands of said rope or cable.

8. A device according to claim 7, wherein said output means includes discriminator means for generating a fault signal when the output of said comparing means exceeds a predetermined tolerance limit.

9. A device according to claim 7, further including switch means for selectively controlling the output of said detector means to said storing means to store in said storing means a signal forming said signal pattern.

10. A device according to claim 7, wherein said wave energy source and said detector means are disposed on opposite sides of said rope or cable, and said detector means comprises means for detecting the absorption properties of said rope or cable.

11. A device according to claim 7, wherein said storing means comprises a digital memory.

12. A device according to claim 7, wherein said storing means comprises an analog memory.

13. A device according to claim 7, wherein said wave energy source is positioned to direct wave energy to said rope or cable at a point downstream of the winding point thereof during the stranding process.

14. A device according to claim 7, wherein said wave energy source is positioned to direct wave energy to a measuring point on said rope or cable, which measuring point is fixed with respct to a longitudinally moving rope or cable.

* * * * *